US005179780A

United States Patent [19]

Wintersteen et al.

[11] Patent Number: 5,179,780

[45] Date of Patent: Jan. 19, 1993

[54] UNIVERSAL SEAMLESS RECEIVER-DEHYDRATOR ASSEMBLY FOR AN AUTOMOTIVE AIR CONDITIONING SYSTEM

[75] Inventors: Douglas C. Wintersteen, Burt; Lynn R. Hamilton, Lockport, both of N.Y.; Donald E. Mikesell, Dayton; Gerald R. Sheets, Springfield, both of Ohio

[73] Assignee: General Motors Corporation, Detroit, Mich.

[21] Appl. No.: 791,302

[22] Filed: Nov. 12, 1991

[51] Int. Cl.[5] ..... B21D 53/00; B23P 15/00

[52] U.S. Cl. ..... 29/890.07; 29/422; 29/455.1; 62/474

[58] Field of Search ..... 29/890, 890.035, 890.036, 29/890.07, 507, 422, 455.1, 523; 62/474, 509

[56] References Cited

U.S. PATENT DOCUMENTS

| | | | |
|---|---|---|---|
| 2,758,719 | 8/1956 | Line | 62/474 X |
| 3,545,227 | 12/1970 | Grahl | 62/474 |
| 4,288,894 | 9/1981 | Jacobellis | 29/422 X |
| 4,291,548 | 9/1981 | Livesay | 62/474 X |
| 4,320,568 | 3/1982 | Herrod et al. | 29/507 X |
| 4,331,001 | 5/1982 | Jones | 62/474 X |
| 4,509,340 | 4/1985 | Mullally et al. | 62/474 X |
| 4,649,719 | 3/1987 | Yanagisawa | 62/474 |
| 4,675,971 | 6/1987 | Masserang | 29/422 |
| 4,698,985 | 10/1987 | Wintersteen | 62/474 |
| 4,788,833 | 12/1988 | Steele | 62/474 |

FOREIGN PATENT DOCUMENTS

| | | | |
|---|---|---|---|
| 0167562 | 7/1989 | Japan | 62/474 |

*Primary Examiner*—Timothy V. Eley
*Assistant Examiner*—C. Richard Martin
*Attorney, Agent, or Firm*—George A. Grove

[57] ABSTRACT

A receiver-dehydrator assembly for use in an automobile air conditioning system is provided which incorporates a seamless, aluminum canister with universal-style inlet-to-outlet connector construction. The universal orientation feature consists of an octagonal perimeter at the top of the canister, which accommodates location of the outlet connector in relation to the inlet connector in any 45 degree radial increment. Mechanical joining processes are employed during the manufacturing of this assembly, so as to maximize the cleanliness and dimensional integrity of the assembly. The versatile, one piece canister design provides a clean, seamless, leak free integral assembly.

7 Claims, 1 Drawing Sheet

UNIVERSAL SEAMLESS RECEIVER-DEHYDRATOR ASSEMBLY FOR AN AUTOMOTIVE AIR CONDITIONING SYSTEM

The present invention relates to the manufacture of a receiver-dehydrator assembly for an automotive air conditioning system. More particularly, this invention relates to the manufacture of such a receiver-dehydrator assembly using mechanical joining processes so as to form a seamless, leakproof assembly having a universal design adaptable to a variety of inlet/outlet configurations.

BACKGROUND OF THE INVENTION

Air conditioning systems are routinely employed within automobiles and other vehicles for creating comfortable conditions within the passenger compartment for the vehicle occupants. At outside temperatures above about 70° F., it is difficult to maintain a comfortable passenger compartment temperature without first cooling the air that is being blown into the passenger compartment.

Typically, cooling of the air is accomplished by first compressing an appropriate refrigerant, such as the fluorocarbon known generally as Freon, or some other alternative refrigerant. Within an automobile, the engine-driven compressor compresses the vaporized refrigerant, thereby significantly raising the temperature of the refrigerant. The refrigerant then flows into a condenser where it is cooled and returned to its liquid state; thus, the heat added to the refrigerant in the compressor is transferred out of the system. The cooled liquid refrigerant is then sprayed through a thermal expansion valve into an evaporator where it is again vaporized. The heat of vaporization required for vaporizing the refrigerant is drawn from the incoming outside air, which is blown through the evaporator. Excess humidity contained within the incoming air is removed as condensation on the evaporator, therefore also drying the incoming air. The cooled, dry air then enters the passenger compartment of the vehicle, while the refrigerant is drawn back to the compressor where it can be again compressed and the cycle repeated.

In this type of automotive air conditioning system, it is common practice to employ a receiver-dehydrator device between the condenser and the thermal expansion valve. The purpose of such a device is to remove any remaining moisture from circulation by the use of a desiccant which is provided within the receiver-dehydrator and to ensure delivery of the refrigerant in a liquid phase to the expansion valve.

Previously, several receiver-dehydrator designs have been proposed for satisfying these design requirements. Generally, the receiver-dehydrator assembly constitutes a cylindrical container having an inlet and an outlet for connecting into the refrigerant circuit. The desiccant is typically contained in a bag which fits into the bottom portion of the cylindrical container. The construction of the receiver-dehydrator assembly is such that refrigerant flow is directed through the desiccant so that the desiccant can perform its intended function of removing moisture from the refrigerant.

Typically, when aluminum or aluminum alloy materials are being used, the fabrication of such receiver-dehydrator assemblies includes the joining of the inlet and outlet connectors to the outside canister assembly by brazing. The brazing process is problematic in that there may be braze residue remaining in the joined regions which may lead to contamination or pinhole leaks within the assembly, thereby potentially causing a loss in the pressurized refrigerant charge. Alternatively, for aluminum or steel materials, arc welding may be used to join the connectors to the outside canister, however the arc welding process is also problematic in that it may result in detrimental dimensional changes to the assembly.

In addition, often the canister will be formed from two separate parts, such as two half shells or a base and a cap, that are joined together around a circular seam. The two parts are typically drawn or stamped. The various internal components of the assembly are assembled into the two separate canister parts before they are seamed together. The seaming process is also particularly vulnerable to the formation of detrimental pinhole leaks if any residue inadvertently remains at the joined surfaces. Further, misalignment of the two shells may occur.

Therefore, although the receiver-dehydrator assembly has become a necessary component within automobile air conditioning systems, the manufacturing processes used to form such assemblies have been less than ideal. Accordingly, the industry needs a method for manufacturing these receiver-dehydrator assemblies which avoids the shortcomings of the prior art. In particular it would be desirable to provide a receiver-dehydrator assembly which is manufactured from one integral piece so that the assembly is seamless to avoid the possibility of leakage, and which is characterized by minimal dimensional distortion resulting from the connection of the inlet and outlet connectors, while retaining the overall integrity of the assembly. Further, it would also be particularly advantageous if the assembly were universally adaptable to a variety of inlet/outlet configurations for enhanced versatility of the assembly.

SUMMARY OF THE INVENTION

It is therefore an object of this invention to provide a receiver-dehydrator assembly for use in an automobile air conditioning system which is characterized by a seamless design.

It is a further object of this invention that such a receiver-dehydrator assembly be manufactured using mechanical joining processes which minimize contamination and dimensional distortion while maximizing the overall integrity of the assembly.

Still further, it is an object of this invention that such an assembly be universally adaptable to a variety of inlet/outlet configurations.

In accordance with a preferred embodiment of this invention, these and other objects and advantages are accomplished as follows.

According to the present invention, there is provided a receiver-dehydrator assembly for use in an automobile air conditioning system which incorporates a seamless aluminum canister with universal-style inlet-to-outlet connector construction. The universal orientation feature consists of an octagonal perimeter at the top of the canister, which accommodates attachment of the outlet connector in relation to the inlet connector in any 45 degree radial increment.

The aluminum canister is formed from drawn aluminum, so as to have an open end. The top end, or closed end, of the canister is then coined to provide an eight-sided, octagonal surface. The inlet and outlet connectors are inertia welded to the flats which are provided by the octagonal surface at the top, closed end of the drawn canister. The inlet and outlet openings through the connectors and the canister wall are formed after the inertia weld process, so as to maximize the dimensional integrity of the final assembly.

Within the drawn canister, the internal pick-up tube (which provides the passageway for the liquid refrigerant to flow back to the compressor so as to be recycled through the air conditioning system) is sealed to the internal diameter of the outlet connector with a mechanical rolling and expansion process, thereby avoiding the possibility of contamination due to braze residue or of dimensional distortion due to welding techniques. The desiccant bag and pick-up filter are then assembled to the internal pick-up tube inside the drawn canister. The open end of the drawn aluminum canister is then sealed with a spin-closure process after the assembly of any other internal components.

The seamless receiver-dehydrator assembly of this invention is manufactured using mechanical joining processes without conventional arc welding or brazing techniques, so as to provide a clean, dimensionally stable, leak free unit.

There are many advantageous features associated with the receiver-dehydrator assembly of this invention. A key feature is the attachment sequence used for attachment of the inlet and outlet connectors. The connectors are mechanically fused to the flats on the octagonal surface on the aluminum canister by an inertia weld process, and then the inlet and outlet holes through the canister are formed. This technique enhances the dimensional integrity of the end point locations within the assembly, since the connectors are not being fixtured to a radius or a previously punched hole—either of which may contribute to end point misalignment. Further, the universal, octagonal top to the canister accommodates the location of the outlet connector in relation to the inlet connector in any 45 degree radial increment.

In addition, the implementation of the other two mechanical joining process, i.e., the mechanical expansion joining of the pick-up tube and the spin closure of the bottom surface of the outside canister, provides a clean, seamless, leak free integral assembly. The mechanical joining processes reduce the possibility of dimensional distortion due to welding, as well as reduce the possibility of contamination of the internal air conditioning system due to flux residues from a brazing process. The one piece canister design also offers a degree of flexibility for the modification of desiccant quantity or the internal volume, by simply adjusting the finished length of the assembly during the spin closure process.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawing wherein.

DETAILED DESCRIPTION OF THE INVENTION

Figure 1:
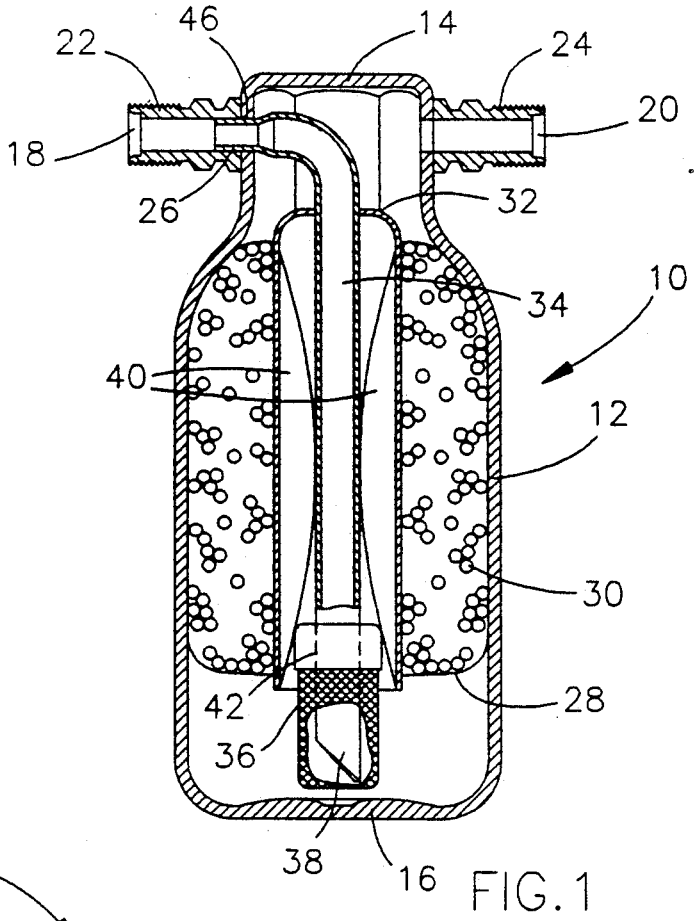
FIG. 1 cross-sectionally illustrates a receiver-dehydrator assembly in accordance with a preferred embodiment of this invention which is suitable for use within an automobile air conditioning system.

As shown cross-sectionally in FIG. 1, there is provided an improved receiver-dehydrator assembly 10 for use in an automobile air conditioning system. The receiver-dehydrator assembly 10 incorporates a one-piece, seamless canister 12 with universal-style inlet-to-outlet connector construction.

The canister 12 is preferably formed from an aluminum alloy which is sufficiently strong yet formable, such as wrought aluminum alloy 6010 or 6061. However, other suitable materials could also be used including steels. The canister 12 is drawn so as to have an integral closed, top end 14 and an oppositely disposed, integral open end which remains open during assembly of the receiver-dehydrator 10. (This open end is subsequently friction spin-closed to form the integral bottom end 16 shown in FIG. 1 as discussed more fully later.) The top end 14, or closed end, of the canister 12 is generally of a reduced diametrical cross-section as compared to the main body of the canister 12 so as to provide a more efficient design for use within an automobile air conditioning system.

Figure 2:
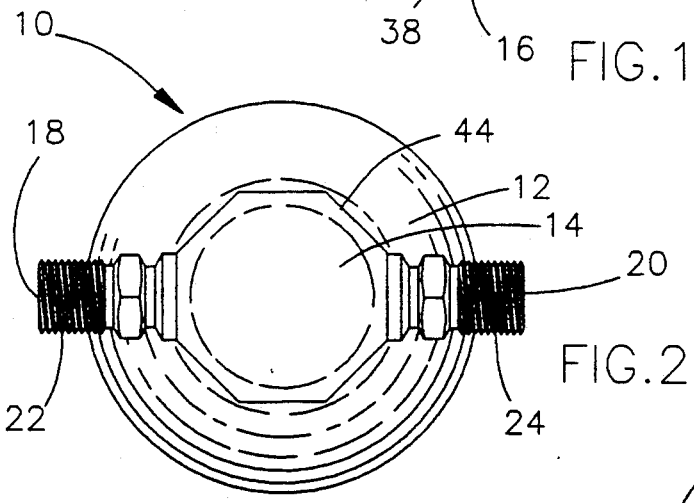
FIG. 2 is a top view of the receiver-dehydrator assembly shown in FIG. 1 and shows the universal octagonal design with inlet and outlet connectors.

As shown more closely in FIG. 2, the region adjacent the top end 14 is coined to provide an octagonal perimeter 44, wherein the eight equal sides of the perimeter 44 are preferably formed to be parallel to the longitudinal axis of the canister 12 of the receiver-dehydrator assembly 10. Other forming methods could also be used to form this octagonal perimeter 44, as well as other symmetrically shaped perimeters formed. The inlet and outlet connectors, 24 and 22 respectively, are each inertia welded to one of the flat surfaces provided by the octagonal perimeter 44. This octagonal perimeter 44 accommodates the universal location of the outlet connector 22 in relation to the inlet connector 24 in any 45 degree radial increment. As shown in both FIGS. 1 and 2, the inlet connector 24 and outlet connector 22 are spaced apart by 180 degrees so as to be diametrically opposed. However, this is not necessary since the connectors 22 and 24 can be provided on adjacent flat surfaces so as to be spaced apart by 45 degrees, or any other 45 degree increment around the octagonal perimeter 44, thereby enhancing the versatility of the design so as to be adaptable to a variety of configurations within automotive air conditioning systems.

It is preferred that the inlet and outlet connectors, 24 and 22 respectively, be also formed from an aluminum alloy such as 6061 heat treated to a T6 condition, and be attached to the octagonal perimeter 44 of the canister 12 by inertia welding techniques. Inertia welding is a solid state, mechanical welding process, which provides a clean, complete weld. When inertia welding, the connector (either 22 or 24) is attached by a spindle chuck to a flywheel and accelerated at a high rate, while the canister 12 is appropriately fixtured. At a predetermined speed, the power is cut to the flywheel and the parts are forced together. The kinetic energy stored in the flywheel is converted to heat by the friction (upon impact) between the two parts to be joined. This heat produces a complete interface weld between the parts. The process is repeated for attachment of the other connector to the octagonal perimeter 44 of the canister 12.

The welds are tested to withstand at least about eleven to thirteen foot-pounds of torque to ensure satisfactory performance during operation, and routinely surpass this requirement. The actual processing parameters, such as the rate of spinning of the connector, depend on many factors including the mass and size of the connector to be fixtured. In the receiver-dehydrator 10 of this invention it is not unusual for the connector to be spun at a high rate, such as up to about 10,000 to 14,000 revolutions per minute, so as to achieve the desired level of kinetic energy. However, the specific parameters are dependent on the specific materials and application, and such evaluations are well within the capability of those skilled in the art.

The inertia weld process rapidly and uniformly produces complete interface welds, with a minimum amount of dimensional upset to the parts, allowing the parts to be maintained to close tolerances. In addition, the possibility of contaminating the internal air conditioning system from flux residues associated with a brazing process is eliminated. Therefore, it is preferred that inertia welding techniques be used to attach the connectors 22 and 24 to the canister 12, though not absolutely necessary. Nor is the use of the preferred alloys necessary, so long as a sufficiently strong yet weldable material is employed.

The inlet connector 24 is in fluidic communication with the condenser unit (not shown) of the air conditioning system. The refrigerant mixture containing the refrigerant and possibly oil for lubrication of the compressor, is drawn into the inlet opening 20 so as to be processed by the receiver-dehydrator assembly 10. The outlet connector 22 is in fluidic communication with the thermal expansion valve (also not shown) of the air conditioning system. The refrigerant is drawn from the bottom of the canister 12 through the pick up tube 34 so as to ensure a continuous flow of liquid to the expansion valve.

An advantageous feature of the receiver-dehydrator assembly 10 of this invention is that the inlet and outlet openings, 20 and 18 respectively, through the connectors, 24 and 22 respectively, and the octagonal canister wall 44 are formed after the inertia weld process, so as to maximize the dimensional integrity of the final assembly 10. This sequence improves the dimensional integrity of the end point locations within the assembly for subsequent hook up and attachment to other components within the air conditioning system, since the connectors 22 and 24 are not being fixtured to a radius or a previously punched hole, either of which may contribute to end point misalignment.

A desiccant container 28 is supported within the main body of the canister 12, and contains an appropriate amount of a suitable desiccant 30 such as a molecular sieve. In practice the desiccant container 28 is uniformly filled with the desiccant 30, however for purposes of illustration of this invention, the desiccant 30 is shown randomly dispersed and grossly exaggerated in size. The desiccant container 28 is preferably provided by a woven fabric bag, but other suitable containers could also be employed. The perforated, woven design allows free flow of the incoming refrigerant mixture from the inlet 20 through the desiccant 30, so that the desiccant 30 can effectively adsorb any moisture entrained within the refrigerant mixture, while allowing the refrigerant to pass through freely.

During the preferred manufacturing sequence, the desiccant container 28 is installed within the canister 12 after installation of the internal pick-up tube 34, as discussed more fully later. The internal pick-up tube 34 is in fluidic communication with the outlet 18 and provides the passageway to the outlet 18 for the liquid refrigerant and oil to flow to the expansion valve for recirculation through the air conditioning system. The inlet end 38 of the internal pick-up tube 34 is disposed so as to receive the liquid components of the refrigerant mixture after they traverse through the desiccant 30.

Figure 3:
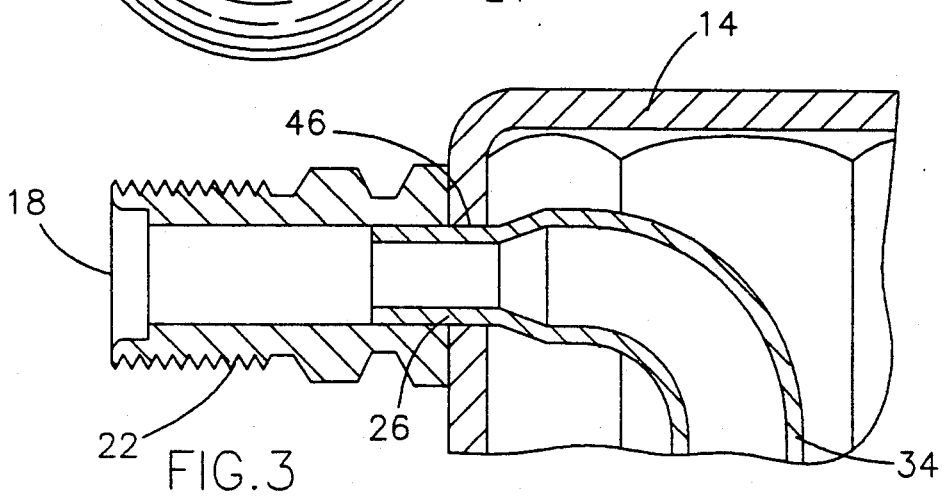
FIG. 3 is an enlarged cross-sectional view through the outlet connector which has been formed in accordance with a preferred embodiment of this invention.

As shown more closely in FIG. 3, the internal pick-up tube 34 is preferably formed from an aluminum alloy, such as the 6061, and formed to have a bent region and a reduced diameter neck 26 to facilitate connection with the outlet 18 passageway. The reduced diameter neck 26 of the internal pick-up tube 34 is sealed to the internal diameter 46 of the outlet connector 22 using a mechanical expansion process. The pick-up tube 34 is inserted so that the reduced diameter neck 26 is positioned within the inner diameter 46 of the outlet 18. The neck 26 of the pick-up tube 34 is then mechanically rolled to expand the diameter of the neck 26 within the inner diameter 46 of the outlet connector 18. The neck 26 of the pick-up tube 34 is rigidly secured by this process within the inner diameter 46 of the outlet 18 by means of a friction interference fit.

By utilizing this mechanical expansion joining process, the possibility of contamination due to braze residue or of dimensional distortion due to welding techniques is eliminated.

A pick-up filter 36 is then preferably attached by conventional means 42 to the inlet end 38 of the pick-up tube 34, so as to prevent the entry of contaminants into the pick-up tube 34 and the thermal expansion valve.

As noted previously, after the assembly of the pick-up tube 34 within the canister 12, the desiccant container 28 is then installed. The desiccant container 28 is rigidly secured within the canister 12 by means of mounting holes provided in the fabric yoke 32, although other suitable means for securing could also be employed.

The open end of the drawn aluminum canister 12 is then sealed to form a closed end 16. The closed end 16 is sealed using a spin-closing process. The initial cut length of the drawn aluminum canister 12 is longer than the finished length of the receiver-dehydrator assembly 10, so as to allow for the closed bottom end 16 formation. The canister 12 is appropriately chucked on the spindle of a spinning machine and then rotated about its longitudinal axis at a suitable speed. An appropriate tool such as a spinning wheel is operated to engage the end of the spinning canister 12 so as to displace the canister 12 material radially inwardly to form the integral bottom end 16. The end 16 typically has a shape which progressively increases in thickness in the radially inward direction, as depicted in FIG. 1.

During the friction spin-closing operation, the spinning rate of the canister 12 and the feed rate of the spinning wheel which is employed to close the end of the canister 12 may be set in such a way that the central region of the closed end 16 actually becomes molten. This technique promotes a superior closure. In addition, the spin-closure technique offers a great degree of flexibility when designing the one-piece receiver-dehydrator assembly 10, since the finished length of the assembly 10 can be appropriately adjusted, for modifications in desiccant quantity or internal volume, during the spin-closure process. As with the inertia welding process previously discussed for attachment of the connectors 22 and 24, the specific processing parameters for this spin-closure technique are dependent on the actual materials and application employed. For the receiver-dehydrator 10 of this invention, the spin-closing may be achieved by spinning the canister 12 at a low rate, such as about 2000 revolutions per minute, while the spinning wheel is spun at an even lower rate of about 20 to 60 revolutions per minute. However, these rates may vary considerably depending on the particular application.

In summary, the receiver-dehydrator assembly 10 of this invention is a seamless, integral structure, which is manufactured using mechanical joining processes, so as to provide a clean, dimensionally consistent, leak free assembly. The advantages of this receiver-dehydrator assembly 10 are many. By inertia welding the connectors 22 and 24 to the flats on the octagonal perimeter 44 of the aluminum canister 12 prior to forming the inlet and outlet holes in the canister 12, the dimensional integrity of the finished assembly is enhanced. In addition, the universal, octagonal perimeter 44 of the canister 12 accommodates the location of the outlet connector 22 in relation to the inlet connector 24 in any 45 degree radial increment. Further, the mechanical joining processes employed to manufacture this receiver-dehydrator assembly 10 reduce the possibility of contamination and dimensional distortion. Lastly, the one piece canister 12 can be modified during the final friction spin-closure technique to allow for variations in internal volume of the canister 12.

Therefore, while our invention has been described in terms of a preferred embodiment, it is apparent that other forms could be adopted by one skilled in the art, such as by modifying the materials or processing steps employed, or by modifying the universal perimeter of the canister, or by modifying the overall design of the receiver-dehydrator assembly. In addition, it is foreseeable that these teachings could be applied to the manufacture of other refrigerant canisters, such as an accumulator-dehydrator for use in an automotive air conditioning system. Accordingly, the scope of our invention is to be limited only by the following claims.

The embodiments of the invention in which an exclusive property or privilege is claimed are defined as follows:

1. A method for seamlessly manufacturing a receiver-dehydrator assembly for an air conditioning system wherein a refrigerant mixture containing refrigerant and oil are circulated therethrough, comprising the following steps:

providing an open-ended canister, said canister having an integrally formed closed end, said closed end having an octagonally-shaped perimeter defining eight surfaces;

attaching an inlet and an outlet 1 each to one of said eight surfaces so as to be in spaced relation to each other, said spaced relation being increments of 45 degrees, said inlet being for receiving the refrigerant mixture and said outlet being for discharging same;

securing a container within said canister, said container containing a desiccant exposed to the interior of said canister, such that the incoming refrigerant mixture is forced through said desiccant so that said desiccant can effectively adsorb any water entrained therein while allowing the liquid components to pass freely through;

mounting liquid passage means within said canister, said liquid passage means having an inlet disposed so as to receive said liquid components after passing through said desiccant, said liquid passage means being in fluidic communication with and attached to said outlet of said canister so as to recirculate said liquid components of said refrigerant mixture within the air conditioning system; and friction spin-closing said open end of said canister to form an integral closed end, thereby housing said container and said liquid passage means within said container;

such that said one piece canister is essentially seamless, and said inlet and said outlet of said canister are selectively attachable to any two of said eight surfaces of said octagonally-shaped perimeter.

2. A method for seamlessly manufacturing a receiver-dehydrator assembly as recited in claim 1 wherein said eight surfaces of said octagonally-shaped perimeter are parallel to the longitudinal axis of said canister.

3. A method for seamlessly manufacturing a receiver-dehydrator assembly as recited in claim 1 wherein said inlet and said outlet are each attached to one of said eight surfaces of said octagonally-shaped perimeter of said canister by inertia welding techniques.

4. A method for seamlessly manufacturing a receiver-dehydrator assembly as recited in claim 1 wherein said one piece canister, said inlet and outlet connectors, and said liquid passage means are formed from one or more aluminum alloys.

5. A method for seamlessly manufacturing a receiver-dehydrator assembly as recited in claim 1 wherein the step of mounting said liquid passage means includes attaching said liquid passage means to said outlet of said canister by first inserting said liquid passage means within said outlet, and then mechanically expanding the inner diameter of said liquid passage means, so as to effectively seal said liquid passage means to the inner diameter of said outlet connector.

6. A method for seamlessly manufacturing a receiver-dehydrator assembly for an air conditioning system wherein a refrigerant mixture containing refrigerant and oil are circulated therethrough, comprising the following steps:

providing an open-ended, aluminum alloy canister, said canister having an integrally formed closed end, said closed end having an octagonally-shaped perimeter defining eight surfaces that are parallel to the longitudinal axis of said canister;

inertia welding an aluminum alloy inlet and an aluminum alloy outlet to a corresponding one of said eight surfaces so as to be in spaced relation to each other, said spaced relation being increments of 45 degrees;

forming inlet and outlet through holes in said canister corresponding to said inlet and said outlet, so that said inlet may receive the refrigerant mixture and said outlet may discharge the same;

securing a container within said canister, said container containing a desiccant exposed to the interior of said canister, such that the incoming refrigerant mixture is forced through said desiccant so that said desiccant can effectively adsorb any moisture entrained therein while allowing the liquid components to pass freely through;

mounting an aluminum alloy liquid passage means within said canister, said liquid passage means having an inlet disposed so as to receive said liquid components after passing through said desiccant, said liquid passage means being in fluidic communication with and attached to said outlet of said canister so as to recirculate said liquid components of said refrigerant mixture within the air conditioning system: and friction spin-closing said open end of said canister to form an integral closed end, thereby housing said container and said liquid passage means within said container;

such that said one piece canister is essentially seamless, and said inlet and said outlet of said canister are selectively attachable to any two of said eight surfaces of said octagonally-shaped perimeter.

7. A method for seamlessly manufacturing a receiver-dehydrator assembly as recited in claim 6 wherein the step of mounting said liquid passage means includes attaching said liquid passage means to said outlet of said canister by first inserting said liquid passage means within said outlet, and then mechanically expanding the inner diameter of said liquid passage means so as to effectively seal said liquid passage means to the inner diameter of said outlet connector.

* * * * *